United States Patent [19]

Lindsay et al.

[11] 3,957,599

[45] May 18, 1976

[54] PROCESS FOR ELECTROWINNING

[75] Inventors: James H. Lindsay, Clarkston; John W. Neumann, Birmingham, both of Mich.

[73] Assignee: Oxy Metal Industries Corporation, Warren, Mich.

[22] Filed: Oct. 2, 1974

[21] Appl. No.: 511,391

[52] U.S. Cl. ..... 204/105 R; 204/269; 204/270; 204/275; 204/277

[51] Int. Cl.[2] ..... C25C 1/00; C25C 7/00

[58] Field of Search ..... 204/105 R, 269, 275, 204/270, 277

[56] References Cited

UNITED STATES PATENTS

| | | | |
|---|---|---|---|
| 3,582,525 | 6/1971 | Hahn et al. | 204/275 |
| 3,728,235 | 4/1973 | Cooley et al. | 204/275 |
| 3,728,244 | 4/1973 | Cooley | 204/275 |
| 3,751,351 | 8/1973 | Zankowski | 204/269 |

*Primary Examiner*—R. L. Andrews
*Attorney, Agent, or Firm*—Richard P. Mueller

[57] ABSTRACT

A process and apparatus designed to recover metal ions from a solution in which the anode is in the form of a vortex diffuser. The vortex diffuser radiates an electrolyte solution upon an ion collector plate in such a manner that the fluid impinges upon the collector perpendicular and then turning parallel to its surface to thereby wipe away any tendency toward dendritic metal formation.

10 Claims, 21 Drawing Figures

PROCESS FOR ELECTROWINNING

BACKGROUND OF THE INVENTION

A number of processes have heretofore been used or suggested for removing metal from an ore. One method in use is to mine the ore by surface workings employing blasting and steam shovel methods. The ore is then delivered to the plant and crushed. The crushed ore is then charged into large concrete leaching vats in which a leaching solution has been prepared or into which the leaching solution will be charged.

The leaching operation takes place in two stages. In the first stage, the copper is dissolved from the ore, and the second stage consists of washing or displacing from the leached ore the water soluble copper that remains. Strong solution resulting from the leaching of the ore is high in copper, low in acid, and is then transported for electrodeposition of part of the copper content.

A similar process is used for the electrowinning of zinc.

Cadmium is found in very small quantities in most ores. It can be profitably produced only as a by-product in the manufacture of some other metal. Cadmium can be recovered from a cadmium-copper-zinc precipitate. The precipitate can be leached with sulfuric acid solutions to dissolve out cadmium and zinc, and the cadmium can be precipitated out of solution by sheet zinc. The precipitated cadmium is then washed and dissolved in an acid electrolyte in which form it is passed to a purification and iron removal system and from there the cadmium is electrodeposited.

After the copper or other metal electrolyte solution is formed, it is necessary to extract the copper or other metal from the solution. One method to accomplish the separation of the metal from the electrolyte solution was suggested by Anderson et al as disclosed in the U.S. Pat. No. 3,483,568. In this patent, there is discosed a plurality of anodes which are suspended in the electrolyte; spaced therefrom are a plurality of cathodes which are comprised of flat sheets parallel to each other. Electrolyte is forced through ports below the cathodes and anodes such that the fluid electrolyte moves successively towards and across the face of an anode and thereafter across the face of a cathode. An electric potential is maintained between the anode and cathode and as the metal is drawn out of the solution, it accumulates on the cathode. One of the problems facing the industry is that accumulations build up on the cathode which are called dendrites, small areas which protrude from the plated cathode and extend toward the anode. When the dendrite becomes long enough it causes a short and the system fails. Further, such a copper deposit is commercially unacceptable, with any type of large dendritic structures.

The present invention provides a unique approach to materially lessening the possibility of dendrite growth by utilizing a vortex diffuser. The vortex diffuser supplies a fluid such as air or electrolyte and creates positive and negative pressures to produce unique effects on a cathode plate which ionically removes the metal from the electrolyte. By using a vortex diffuser, a separate anode can be eliminated from the electrolytic bath, because the vortex diffuser itself functions as the anode and relatively high current densities can be used.

SUMMARY OF THE INVENTION

The benefits and advantages of the present invention are achieved by an air or fluid carrying device comprising a member formed with at least one cavity therein having an opening at a surface of the member from which a pressurized fluid such as air or a liquid is discharged in the form of a vortex. The vortex producing member is adapted to coact with a body disposed in spaced relationship relative to the surface of the body in a manner to concurrently apply attracting and repelling forces thereto. The vortex member also functions to apply a violent, swirling motion to the electrolyte solution and the nature of the motion of the electrolyte and its interaction with a cathode is a function of the distance separating the vortex producing member from the cathode.

When a fluid or air under pressure passes through the vortex diffuser member, after being placed in an electrolyte solution, the solution radiates circularly about the face of an adjacent cathode thereby scrubbing it and preventing a deleterious depletion of metallic ions on the surface of the cathode which inhibit further plating out of the solution. Dendrite growth is also inhibited because the scrubbing action of the radiating solution prevents any unusually high deposit of metal at any point of the cathode.

Description of the Preferred Embodiment

Figure 1:
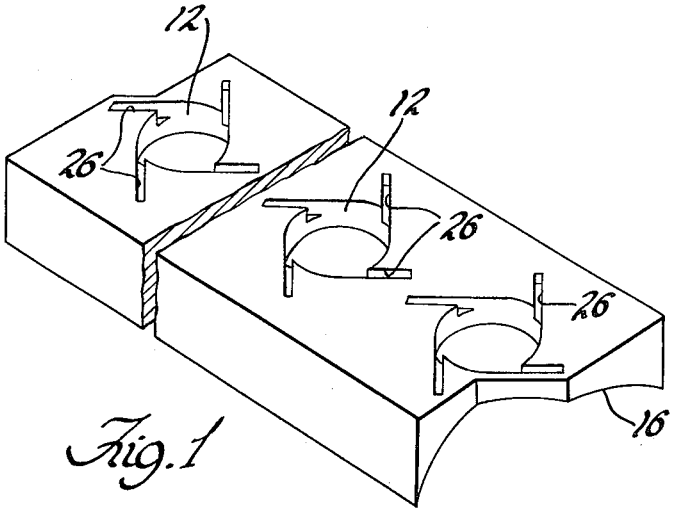
FIG. 1 is a perspective view of a vortex diffuser.
Figure 2:
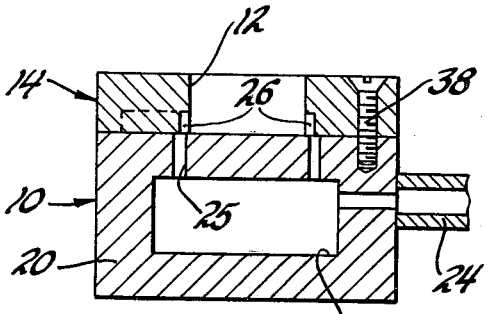
FIG. 2 is an end view in section of a vortex diffuser taken along the line 2—2 of FIG. 5.

Referring now in detail to the drawings, and as may be best seen in FIGS. 1 and 2, the vortex diffuser device is shown in the form of an elongated rail 10 which can have one or a plurality of vortex diffusers or cavities approximately one-half to two inches in diameter disposed at longitudinally spaced increments therealong. The assembly 10 comprises a section 14 which, in the exemplary embodiment shown, is formed with a supporting surface 16 which can be arcuate, concave, convex, or flat. A manifold section 20 is securely affixed to the underside of the assembly 10 defining a supply chamber 22 from which a pressurized fluid in the form of a gas or a liquid is supplied to each of the vortex diffusers 12. The interior of the supply chamber 22 may be suitably connected to a source of pressurized fluid by means of a supply conduit 24 as illustrated in FIG. 2.

Figure 3:
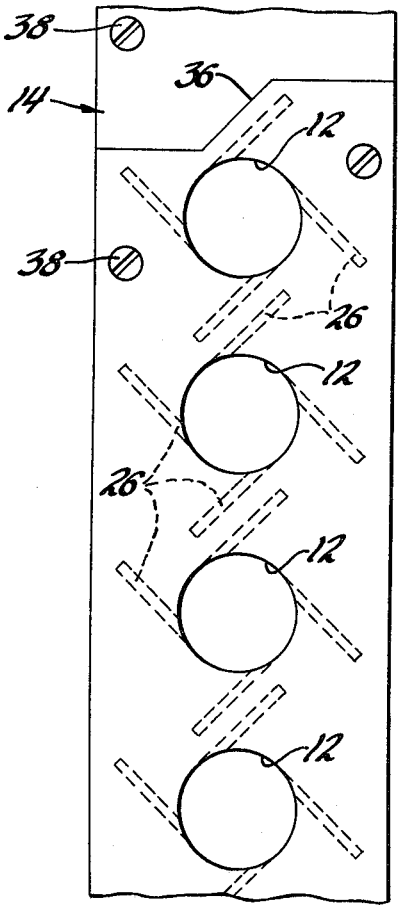
FIG. 3 is a plan view of a vortex diffuser showing channels in dotted lines.
Figure 4:
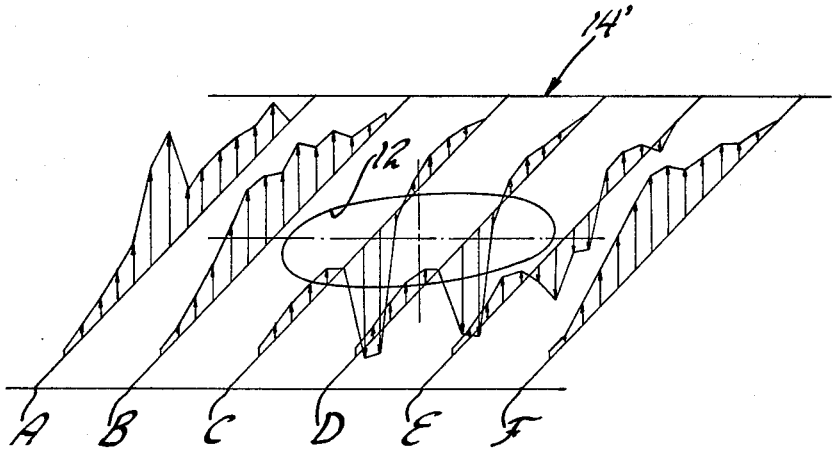
FIG. 4 is a graph showing pressure distribution around the periphery of a cavity in a vortex diffuser.
Figure 5:
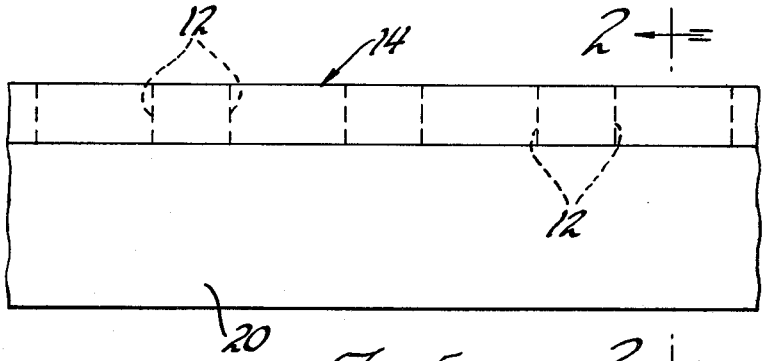
FIG. 5 is a sideview in elevation of a vortex diffuser.

As best seen in FIGS. 2–4, each of the vortex diffusers or cavities 12 is disposed in communication with the supply chamber 22 by means of four, however this number could be more or less, vertical ports or orifices 25 each of which communicates with one of four tangentially oriented jets 26 whereby the pressurized fluid enters adjacent to the base of the vortex diffuser and moves in a helical manner outwardly toward the open end thereof at which it comes in contact with the surface of an article such as a cathode disposed in clearance relationship relative to the surface 16. The orifices 25 are of a size in relation to the pressure and volume of fluid in the supply chamber 22 such that the flow of fluid into each vortex diffuser is substantially independent and unaffected by variations in flow rates of adjacent vortex diffusers.

The provision of four or more or less jets 26 disposed at substantially equal circumferential increments provides for the formation of a substantially uniform vortex fluid which does not have a residual linear component. The particular pressure pattern will vary depending on the configuration of the surface 16, the pressure and velocity of the fluid forming the vortex in each of the cavities 12, the configuration and conformation of the peripheral surface of an object or fluid relative to the surface of the vortex rail section, the density of the fluid substance, the spacing or distance of the clearance gap between the surface 16 and the article such as the cathode, the longitudinal spacing of adjacent vortex diffusers, the number and position or orientation of jets disposed in communication with each of the vortex diffusers for supplying pressurized fluid thereto, the specific contour or configuration of the wall defining the cavity comprising the vortex diffuser including the shape of the corner at which the cavity meets the supporting surface 16, and the general smoothness of the adjacent surfaces in contact with the flowing fluid. The specific pressure pattern illustrated in FIG. 4 is that derived from readings taken at longitudinally spaced increments of about ½ an inch from a flat cathode plate.

FIG. 4 illustrates the pressure differential pattern obtained at fourteen points along each of six transverse planes A–F with the profile disposed above the lines A–F denoting a superatmospheric pressure, while those portions below denote a subatmospheric pressure reading. As will be noted in FIG. 4, the pressure patterns along traverse lines A, B, and F denote the existence of superatmospheric pressures along the entire traverse, whereas subatmospheric pressures are encountered at the center portions of the traverse along lines C, D, and E.

Figure 21:
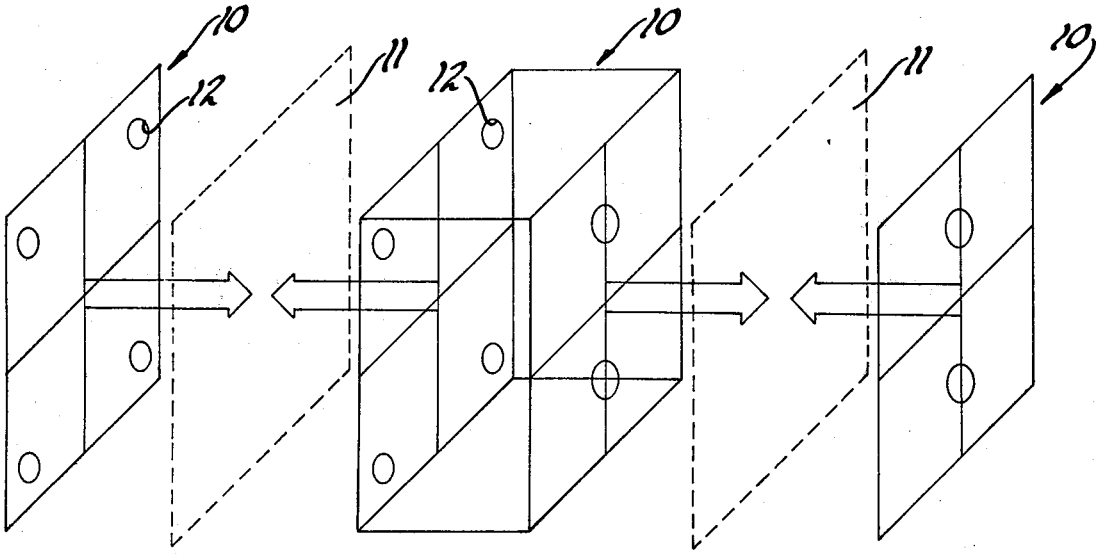
FIG. 21 is a perspective view showing two possible patterns impinging on both cathode sides.

In accordance with the foregoing operating characteristics of the assembly, it will be appreciated that a variety of alternative satisfactory constructions can be employed consistent with the intended end use of the system. In the specific embodiments shown in FIGS. 1–4, each section 14 may conveniently be cast or extruded metal, plastic or other suitable material in the form of individual sections having Z-shaped end sections indicated at 36 in FIG. 3, which serve to assure accurate alignment of adjacent sections. A side-by-side abutting relationship can also be formed. The individual sections 14 can be securely fastened to the upper surface of the manifold section 20 by means of a series of screw 38 having the head portions thereof disposed in countersunk relationship relative to the surface 16. It should be further appreciated that while the assembly as described is stationary with respect to the cathode to be plated, it is also contemplated that the assembly 10 may be affixed to a movable member which moves the assembly in any desired pattern with respect to the cathode. On the other hand, one might maintain the assembly 10 stationary and provide means to move the cathodes in any desired motion. It should be borne in mind, however, that a movable air rail is not at all times required, and that the preferred configuration is as shown in FIG. 21 wherein there is disclosed a "lattice" of vortices in a relatively larger anode plate.

Figure 6:
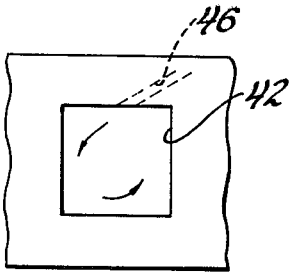
FIG. 6 is a plan view of a modification.
Figure 7:
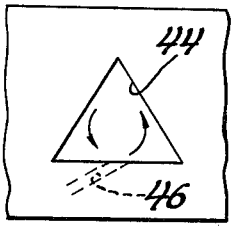
FIG. 7 is a plan view of a second modification.
Figure 8:
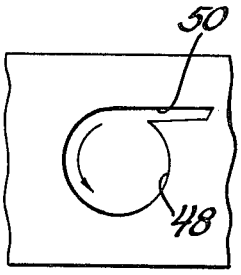
FIG. 8 is a plan view of a third modification.

In addition to the substantially circular cylindrical configuration of the vortex diffuser 12 as shown in FIGS. 1–3 of the drawings, alternative satisfactory configuration can be employed in order to obtain desired variations in the configuration of the fluid vortex produced and the pressure patterns thereof. As noted in FIG. 6, a vortex diffuser 42 is shown having a substantially square transverse cross-sectional configuration. A vortex diffuser 44 as is illustrated in FIG. 7 preferably is of substantially equilateral triangular transverse cross-sectional configuration. Pressurized fluid is supplied to the vortex diffusers 42, 44 by means of jets 46 such that the fluid rotates in a circular direction as illustrated by the arrows in FIGS. 6 and 7, forming a vortex. It will be appreciated that although the vortex diffusers of FIGS. 6 and 7 are of a configuration other than circular, the fluid has a tendency to form static portions in the corners of such irregularly shaped cavities whereby a central substantially circular operative section is created. It is also contemplated that a vortex diffuser 48 of a generally scroll-shaped configuration, as shown in FIG. 8 can be employed to advantage in some instances for providing a highly efficiency configuration for producing a vortex. In the vortex diffuser 48, a jet 50 is disposed with its axis substantially tangential to the periphery of the cavity defining the vortex diffuser thereby minimizing turbulence.

Figure 9:
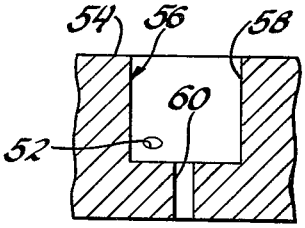
FIGS. 9–20 each show a side view in cross-section of a different modification of the invention.

Alternative satisfactory longitudinal cross-sectional configuration of vortex diffusers are illustrated in FIGS. 12–23. The vortex diffusers illustrated in these figures are of a substantially circular transverse cross-sectional configuration and vary in diameter and/or contour on moving outwardly from an inlet jet 52 toward the face surface 54 thereof whereby a desired variation in the vortex discharged therefrom is attained. In FIG. 9 a vortex diffuser 56 is shown which is is of substantially equal diameter along the length thereof and is formed with a flat bottom wall 58. The pressurized fluid is adapted to be discharged in a substantially tangential direction into the vortex diffuser 56 through the jet 52 in a direction substantially parallel to the plane of the bottom wall 58. The arrangement shown in FIG. 9, while somewhat similar to the vortex diffuser 12 shown in FIGS. 1–3, is illustrative of still a further embodiment of the present invention in which a port or aperature 60 is formed in the base of the vortex diffuser 56 for supplying the same or an alternative fluid to or withdrawing fluid from the interior of the cavity to provide a desired variation in the flow and pressure pattern of the vortex discharged therefrom. The port or aperature 60 is connected to a suitable source of pressurized fluid (not shown) for supplying the supplemental fluid thereto. Alternatively, the port 60 can be connected to a suitable source of a reduced pressure for extracting a controlled amount of fluid from the vortex diffuser cavity on a continuous or intermittent basis as may be desired to achieve a desired effect.

Figure 10:
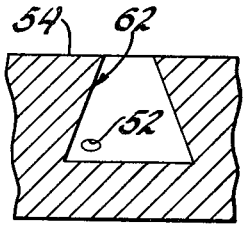
Figure 11:
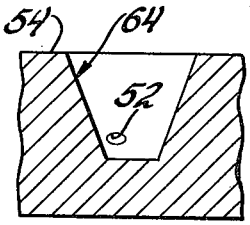
Figure 12:
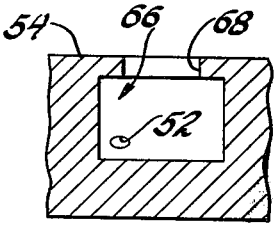
Figure 13:
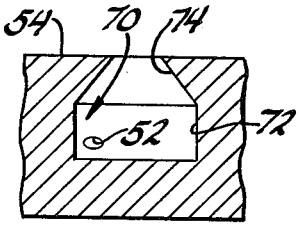
Figure 14:
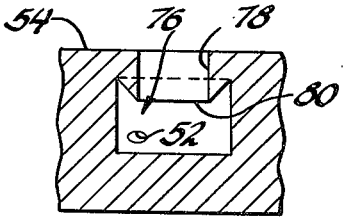

A vortex diffuser 62 is illustrated in FIG. 10 which is of a conical converging configuration whereas a vortex diffuser 64 is shown in FIG. 14 of a conical outwardly diverging configuration. A vortex diffuser 64 is shown in FIG. 11 and which is conical and generally divergent to its lower extremity. A vortex diffuser 66 is shown in FIG. 12 which is of a substantially cylindrical configuration and is provided with an annular shoulder 68 of a reduced diameter adjacent to the surface 54. A vortex diffuser 70 is illustrated in FIG. 13 comprised of a substantially cylindrical lower section 72 and a conical converging outer section 74.

Figure 15:
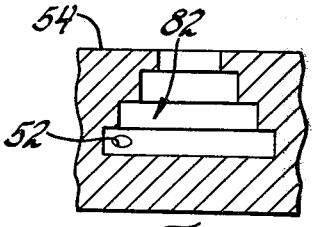
Figure 16:
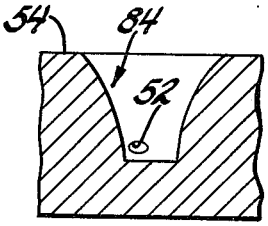

FIG. 14 illustrates a vortex diffuser 76 having an annular shoulder 78 of reduced diameter which is formed with a chamfered edge indicated at 80 at its inner end. A vortex diffuser 82 is shown in FIG. 15 which is of a converging square stepped configuraton going from the inside thereof outwardly toward the face surface 54. A divergent vortex diffuser 84 is shown in FIG. 16 in which the side walls thereof are of a parabolic curvature.

Figure 17:
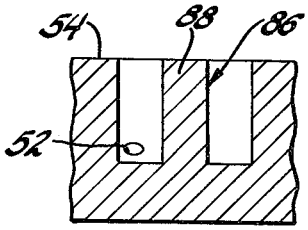
Figure 18:
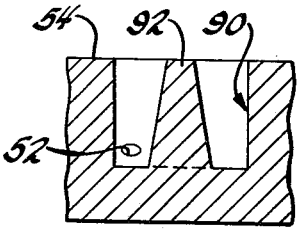

A vortex diffuser 86 is shown in FIG. 17 which is of a substantially circular cylindrical configuration and incorporates a substantially concentric central cylindrical core 88 forming an annular cavity. A vortex diffuser 90 as illustrated in FIG. 18 is similar to that shown in FIG. 20 but the central core 92 is of a truncated conical configuration. It will be noted in FIGS. 17 and 19 that the end portions of central cores 88, 92 terminate at a point disposed in the plane of the face surface 54.

Figure 19:
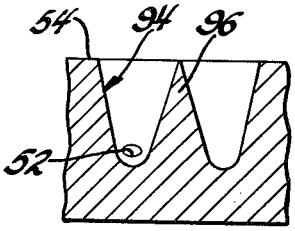
Figure 20:
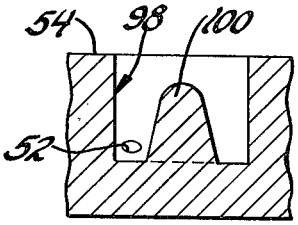

A vortex diffuser 94 is illustrated in FIG. 19 which is formed with outwardly divergent arcuate walls and a conical central core 96 terminating at a point lying in the plane of the surface 54. A vortex diffuser 98 is shown in FIG. 20 which is formed with a substantially circular cylindrical outer wall and an arcuate central core 100 disposed concentrically thereof which terminates at a point spaced inwardly of the plane of the face surface 54.

It will be appreciated that still other alternatives and configurations of vortex diffusers from those shown in FIGS. 6 through 20 can be employed in order to provide the desired operating characteristics consistent with the intended end use of the system.

In the various fluid rail arrangements previously described a single rail is employed for creating a vortex within an electrolyte solution. It is also contemplated within the scope of the present invention that two or more fluid rail assemblies can be employed by placing a plurality of rails on one side of a cathode or, alternatively, placing one or more rails on both sides of a cathode.

FIG. 21 illustrates the use of two fluid rail assemblies 118 which are disposed in diametrically opposed relationship on either side of a cathode 124. Thus the rail 118 can serve as an anode having vortices therein. The cathode 124 will receive metallic ions from the electrolyte solution and both sides of the cathode will be plated thereby providing a faster rate of removal of metallic ions from the solution.

In FIG. 21, there is shown a vortex diffuser assembly 10 which is immersed in an electrolyte solution containing metal ions, for example, copper. The vortex diffuser assembly 10 comprises the anodic portion of an electrolytic couple. A sheet 11 of the metal to be plated out of the solution, for example, copper, is suspended adjacent the face of the vortex diffuser at a distance between one-half inch and three inches away. The sheet 11 comprises the cathodic portion of the electrolytic couple and it is upon this sheet that metallic ions from the solution will plate when a current flow occurs between the anode and the cathode.

The electrolyte can be pumped through the pipe 24 into the manifold 20. The pressurized electrolyte solution will then flow through the openings 25 and out the cavity 12. As can be seen from FIG. 4, the solution will be under a negative pressure at the center of the cavity 12 and a positive pressure at the peripheral portion of the cavity. The pressurized fluid will flow out of the cavity as a turbulent, vertical-radiating and horizontally-moving fluid which will continuously wipe the surface of the cathode 11.

The wiping effect enhances the supply of ions to the cathode, increasing plating efficiency. The metal is plated out of the solution onto the cathodic sheet 11 when a potential is impressed across the face of the cathode and the anode.

A vortex diffuser 10 could also be placed on the opposite side of the cathodic plate 11 so that plating onto the cathode can be accomplished on both sides of the latter. In FIG. 21, there is shown a plurality of vortex diffusers and cathode plates.

It has been found that good plating results have been obtained by utilizing 5 to 10 psi pressure at 100 amps per square foot. Thus, the amount of energy required to operate the system is relatively low with respect to the amount of metal which is plated out of solution. For maximum plating efficiency, the anode and cathode should not be spaced farther than two inches apart.

While a specific form of the invention has been discussed herein, it will be obvious to those skilled in the art that modifications can be made within the skill of the art; however, the measure of the invention is to be interpreted in the light and scope of the claims appended hereto.

I claim:

1. A process for plating a metal onto a substrate which comprises forming an electrolyte solution which contains a metal to be plated in a form suitable for electrolytic deposition, placing a positively-charged manifold in the electrolyte solution as an anode, said manifold anode having at least one opening therein, placing a negatively-charged substrate in the electrolyte solution as a cathode, said cathode substrate being disposed in the electrolyte so as to be in substantial parallel relationship with the opening in said manifold anode, pumping a fluid through the manifold and out through the opening therein, causing said fluid to form an outwardly expanding vortex as it is discharged from said opening in a direction that is substantially perpendicular to said cathode substrate, maintaining the distance between the manifold anode and the cathode substrate such that the fluid flow at the surface of the cathode substrate is substantially parallel thereto and passing an electric current through the electrolyte solution between the manifold anode and the cathode substrate at a current density that is sufficient to effect deposition of the metal in the electrolyte solution onto the cathode substrate.

2. The process as claimed in claim 1 wherein the fluid pumped through the manifold anode is the electrolyte solution.

3. The process as claimed in claim 2 wherein the electrolyte solution is discharged through the manifold anode opening at a pressure that is not substantially in excess of 20 lbs. per sq. inch.

4. The process as claimed in claim 3 wherein the spacing between the manifold anode and the cathode substrate is not substantially in excess of 4 inches.

5. The process as claimed in claim 4 wherein a second manifold anode is placed on the opposite side of the cathode substrate, in substantially parallel relationship thereto, and an electric current is also passed through the electrolyte solution between the cathode substrate and the second manifold anode while the electrolyte solution in the form of the outwardly expanding vortex is discharged from the opening in said second manifold toward said cathode substrate, whereby the metal in the electrolyte solution is deposited on both sides of the cathode substrate.

6. The process as claimed in claim 1 wherein the fluid pumped through the manifold anode is air.

7. The process as claimed in claim 1 wherein a second manifold anode is placed on the opposite side of the cathode substrate, in substantially parallel relationship thereto, and an electric current is also passed through the electrolyte solution between the cathode substrate and the second manifold anode while the fluid, in the form of the outwardly expanding vortex, is discharged from the opening in said second manifold toward said cathode substrate, whereby the metal in the electrolyte is deposited on both sides of the cathode substrate.

8. In a process for plating metallic atoms as defined in claim 1 further comprising the step of directing said fluid toward said substrate in a substantially perpendicular direction then turning parallel at the substrate.

9. The process as defined in claim 1 in which the electrolyte is forced through said port at a pressure not to exceed 20 pounds per square inch.

10. The process as defined in claim 1, comprising the further step of maintaining the anode and cathode spaced from each other in which said spacing does not exceed 4 inches.

* * * * *